US008695479B2

(12) United States Patent
Mitsch

(10) Patent No.: US 8,695,479 B2
(45) Date of Patent: Apr. 15, 2014

(54) SINGLE-ACTING PNEUMATIC CYLINDER FOR USE ON A LOCOMOTIVE PLATFORM

(75) Inventor: Matthew D. Mitsch, Pittsburgh, PA (US)

(73) Assignee: Wabtec Holding Corp., Wilmerding, PA (US)

( * ) Notice: Subject to any disclaimer, the term of this patent is extended or adjusted under 35 U.S.C. 154(b) by 964 days.

(21) Appl. No.: 12/416,968

(22) Filed: Apr. 2, 2009

(65) Prior Publication Data

US 2010/0050860 A1 Mar. 4, 2010

Related U.S. Application Data

(60) Provisional application No. 61/092,952, filed on Aug. 29, 2008.

(51) Int. Cl.
*F01B 3/00* (2006.01)

(52) U.S. Cl.
USPC ..... 92/113; 92/187

(58) Field of Classification Search
USPC ..... 92/172, 168, 187, 109, 113, 171.1, 92/130 R, 59, 165 R; 188/153 R
See application file for complete search history.

(56) References Cited

U.S. PATENT DOCUMENTS

| | | | |
|---|---|---|---|
| 444,182 | A | 1/1891 | Robinson |
| 938,490 | A | 11/1909 | Kintner |
| 1,113,370 | A | 10/1914 | Ostendorf |
| 1,201,622 | A | 10/1916 | Putnam |
| 1,295,644 | A | 2/1919 | Ver Planick |
| 1,359,175 | A | 11/1920 | Kellogg et al. |
| 1,747,902 | A | 2/1930 | Marcum |
| 1,922,227 | A | 8/1933 | Brecht |
| 1,937,896 | A | 12/1933 | Johnson |
| 1,958,489 | A | 5/1934 | Moulton |

(Continued)

FOREIGN PATENT DOCUMENTS

| | | | |
|---|---|---|---|
| GB | 2076705 | A | 12/1981 |
| GB | 2080421 | A | 2/1982 |

(Continued)

OTHER PUBLICATIONS

JP-03-67702-U to Kayaba Industry Co Ltd, Jul. 2, 1991.*

(Continued)

*Primary Examiner* — Edward Look
*Assistant Examiner* — Logan Kraft
(74) *Attorney, Agent, or Firm* — The Webb Law Firm

(57) ABSTRACT

The pneumatic cylinder includes a cylinder body, a non-pressure head, a hollow piston rod, a piston head, and a push rod. The cylinder body has a mounting flange and an inlet port. The non-pressure head has a mounting flange. The hollow piston rod has an open end and a closed end. The piston head is secured to the hollow piston rod and defines the closed end of the hollow piston rod. The push rod has a socket end inserted within the hollow piston rod and a coupler end. The non-pressure head has a hollow rod guide bearing and a hollow rod seal and the piston head has a piston guide bearing and a piston seal. The hollow rod guide bearing and the hollow rod seal each slidably engage the hollow piston rod. The piston guide bearing and the piston seal each slidably engage the cylinder body.

16 Claims, 7 Drawing Sheets

(56) References Cited

U.S. PATENT DOCUMENTS

| | | | | |
|---|---|---|---|---|
| 2,018,312 | A | 10/1935 | Moulton | |
| 2,083,686 | A * | 6/1937 | Campbell | 92/130 R |
| 2,597,917 | A | 5/1952 | Bent | |
| 2,930,606 | A | 3/1960 | Trumper | |
| 2,982,466 | A | 5/1961 | Pier | |
| 3,202,062 | A | 8/1965 | Burden | |
| 3,227,053 | A | 1/1966 | Spalding | |
| 3,318,198 | A * | 5/1967 | Newell | 91/401 |
| 3,559,587 | A | 2/1971 | Jones et al. | |
| 3,786,763 | A | 1/1974 | Pollinger | |
| 3,795,201 | A | 3/1974 | Tack | |
| 4,029,305 | A | 6/1977 | Schubert et al. | |
| 4,097,063 | A | 6/1978 | Dean | |
| 4,323,003 | A * | 4/1982 | Clippard, III | 92/87 |
| 4,515,530 | A | 5/1985 | Christoleit | |
| 4,976,454 | A | 12/1990 | Bohn | |
| 5,125,322 | A | 6/1992 | Hugdahl | |
| 5,495,921 | A | 3/1996 | Samulak et al. | |
| 5,630,354 | A * | 5/1997 | Hoffner et al. | 92/168 |
| 6,948,417 | B2 | 9/2005 | Futami et al. | |
| 7,168,370 | B2 | 1/2007 | Hommen et al. | |
| 7,185,592 | B2 | 3/2007 | Hommen et al. | |
| 7,243,606 | B2 | 7/2007 | Hommen et al. | |
| 7,249,659 | B2 | 7/2007 | Huber, Jr. et al. | |
| 7,377,736 | B1 | 5/2008 | Fujii et al. | |
| 2002/0170426 | A1 | 11/2002 | Braatz | |
| 2005/0194727 | A1 * | 9/2005 | Chung | 267/118 |
| 2009/0277736 | A1 * | 11/2009 | McAndrews et al. | 188/314 |

FOREIGN PATENT DOCUMENTS

| | | | |
|---|---|---|---|
| JP | 2000240609 | A | 9/2000 |
| JP | 2001234904 | A | 8/2001 |
| JP | 2001248610 | A | 9/2001 |
| JP | 2001304205 | A | 10/2001 |
| JP | 2003294013 | A * | 10/2003 |
| KR | 1019900014769 | A | 10/1990 |
| RU | 2304737 | C1 | 5/2007 |
| SU | 143285 | A1 | 1/1961 |

OTHER PUBLICATIONS

KR-97-18607 to Kongyang Mechatronics, May 26, 1997.*

WABTEC Corporation, "UAHT" Brake Cylinders, Operation and Maintenance Instruction, Nov. 1989.

* cited by examiner

SINGLE-ACTING PNEUMATIC CYLINDER FOR USE ON A LOCOMOTIVE PLATFORM

CROSS REFERENCE TO RELATED APPLICATIONS

This application claims priority to U.S. Provisional Patent Application No. 61/092,952 entitled "Single-Acting Pneumatic Cylinder for Use on a Locomotive Platform" filed Aug. 29, 2008.

BACKGROUND OF THE INVENTION

1. Field of the Invention

This disclosure relates to a pneumatic cylinder and, more particularly, a single-acting, desirably low-friction pneumatic cylinder for use on a locomotive platform.

2. Description of Related Art

Pneumatic cylinders typically include a cylinder body and a piston and rod assembly to transmit a force and displace the piston and rod assembly. In particular, single-acting pneumatic cylinders admit air pressure on a pressure side of the cylinder body to move the rod and piston assembly with a force generally proportional to the air pressure acting on the piston.

For example, U.S. Pat. No. 5,630,354 discloses a brake cylinder having a brake cylinder body, a head casing, a piston and rod assembly, and a push rod assembly. The piston and rod assembly includes a hollow piston rod having a diaphragm piston head at a closed end thereof. A release spring is concentrically disposed about the hollow piston rod between first and second spring seats. The push rod assembly has a socket end and a coupler end. The socket end inserts within the hollow piston rod via an open end and the coupler end couples to brake rigging.

U.S. Pat. No. 2,930,606 to Trümper discloses an axle supported on a vehicle frame by two piston rods with opposed ball-shaped heads. Each rod rests on a piston which slides in cylinder. A conduit leads from each cylinder to a common connecting conduit. Another conduit branches from the connecting conduit leading to a pressure space in which a piston slide valve operates and in which a column of spring washers or an air spring may be disposed. In operation, the weight of the vehicle compresses pressure liquid in the cylinder and this in turn compresses the springs. The piston cylinder in the Trümper patent operates with a liquid rather than pneumatic pressure.

U.S. Pat. No. 1,295,644 to Ver Planck discloses a piston cylinder operable for supporting a vehicle body on a truck. The cylinder piston is pneumatically operated.

U.S. Pat. Nos. 7,243,606; 7,168,370; and 7,185,592, all to Hommen et al., disclose a pneumatic spring for raising the level of the superstructure of a rail vehicle. The Hommen '606 patent discloses a hydro-pneumatic spring that includes a lower pendulum support and a corresponding pressure chamber.

U.S. Pat. No. 4,097,063 to Dean and U.S. Pat. No. 3,786,763 to Pollinger disclose pneumatic spring devices for railway vehicles.

U.S. Pat. Nos. 2,018,312 and 1,958,489 to Moulton disclose a shock-absorber unit that operates as a double-acting piston cylinder shock absorbing arrangement.

U.S. Pat. No. 1,201,622 to Putnam discloses a four-piston cylinder arrangement for shock-absorbing purposes in a rail vehicle.

U.S. Pat. No. 444,182 to Robinson discloses an air spring device wherein a piston and a cylinder each have a ball-socket connection for connection to a truck frame on one side and an equalizer on the other.

SUMMARY OF THE INVENTION

Generally, a pneumatic cylinder is detailed herein and which comprises a cylinder body, a non-pressure head, a hollow piston rod, a piston head, and a push rod. The cylinder body comprises an inlet port. The non-pressure head is connected to an end of the cylinder body. The hollow piston rod comprises an open end and a closed end. At least a portion of the hollow piston rod is disposed within the non-pressure head. The piston head is associated with the hollow piston rod and defines the closed end of the hollow piston rod. The piston head is disposed within the cylinder body and is displaceable relative to the cylinder body. The push rod comprises a socket end and a coupler end. The socket end is seated within the hollow piston rod to permit arcuate movement of the push rod relative to the piston head.

The cylinder body and the non-pressure head may comprise mating mounting flanges to secure the non-pressure head to the cylinder body. The piston head and associated piston rod may be axially displaceable in the cylinder body. The coupler end of the push rod may comprise a U-shaped mounting bracket. The non-pressure head may comprise a hollow rod guide bearing and a hollow rod seal. The hollow rod guide bearing and the hollow rod seal each slidably engage the hollow piston rod. The piston head may have a piston guide bearing and a piston seal and the piston guide bearing and the piston seal may each slidably engage the cylinder body. A vent may be provided in the non-pressure head. The cylinder body may comprise a mounting portion.

In another embodiment, the pneumatic cylinder generally comprises a cylinder body, a non-pressure head, a hollow piston rod, a piston head, a push rod, and a push rod holder. The cylinder body comprises an inlet port. The non-pressure head is connected to an end of the cylinder body. The hollow piston rod comprises an open end and a closed end, at least a portion of the hollow piston rod is disposed within the non-pressure head. The piston head is associated with the hollow piston rod and defines the closed end of the hollow piston rod. The piston head is disposed within the cylinder body and is displaceable relative to the cylinder body. The push rod comprises a socket end and a coupler end and the socket end is seated within the hollow piston rod. The push rod holder is secured to the piston rod and further connected to the hollow push rod to permit arcuate movement of the push rod relative to the piston head.

The cylinder body and the non-pressure head may comprise mating mounting flanges to secure the non-pressure head to the cylinder body. The piston head and associated piston rod may be axially displaceable in the cylinder body. The coupler end of the push rod may comprise a U-shaped mounting bracket. The non-pressure head may comprise a hollow rod guide bearing and a hollow rod seal. The hollow rod guide bearing and the hollow rod seal each slidably engage the hollow piston rod. The piston head may have a piston guide bearing and a piston seal and the piston guide bearing and the piston seal may each slidably engage the cylinder body. A vent may be provided in the non-pressure head. The cylinder body may comprise a mounting portion.

The push rod holder may support a holder pin passing through the push rod such that the push rod moves with the piston rod during movement thereof. In yet another embodiment, the pneumatic cylinder comprises a cylinder body, a non-pressure head, a hollow piston rod, a piston head, a push rod, and an elastomeric ring. The cylinder body comprises an inlet port. The non-pressure head is connected to an end of the cylinder body. The hollow piston rod comprises an open end and a closed end, at least a portion of the hollow piston rod is disposed within the non-pressure head. The piston head is associated with the hollow piston rod and defines the closed end of the hollow piston rod. The piston head is disposed within the cylinder body and is displaceable relative to the cylinder body. The push rod comprises a socket end and a coupler end and the socket end is seated within the hollow piston rod. The elastomeric ring is concentrically positioned about the socket end of the push rod and engages the hollow piston rod to permit arcuate movement of the push rod relative to the piston head. The elastomeric ring may comprise a solid rubber ring. The elastomeric ring may be seated against a flange formed adjacent the socket end of the push rod.

Further details and advantages with become clear upon reading the following detailed description in connection with the accompanying drawings, wherein like parts are designated with like parts throughout.

DESCRIPTION OF THE PREFERRED EMBODIMENTS

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific pneumatic cylinder illustrated in the accompanying drawing figures and described herein is simply exemplary and should not be considered as limiting.

Figure 1:
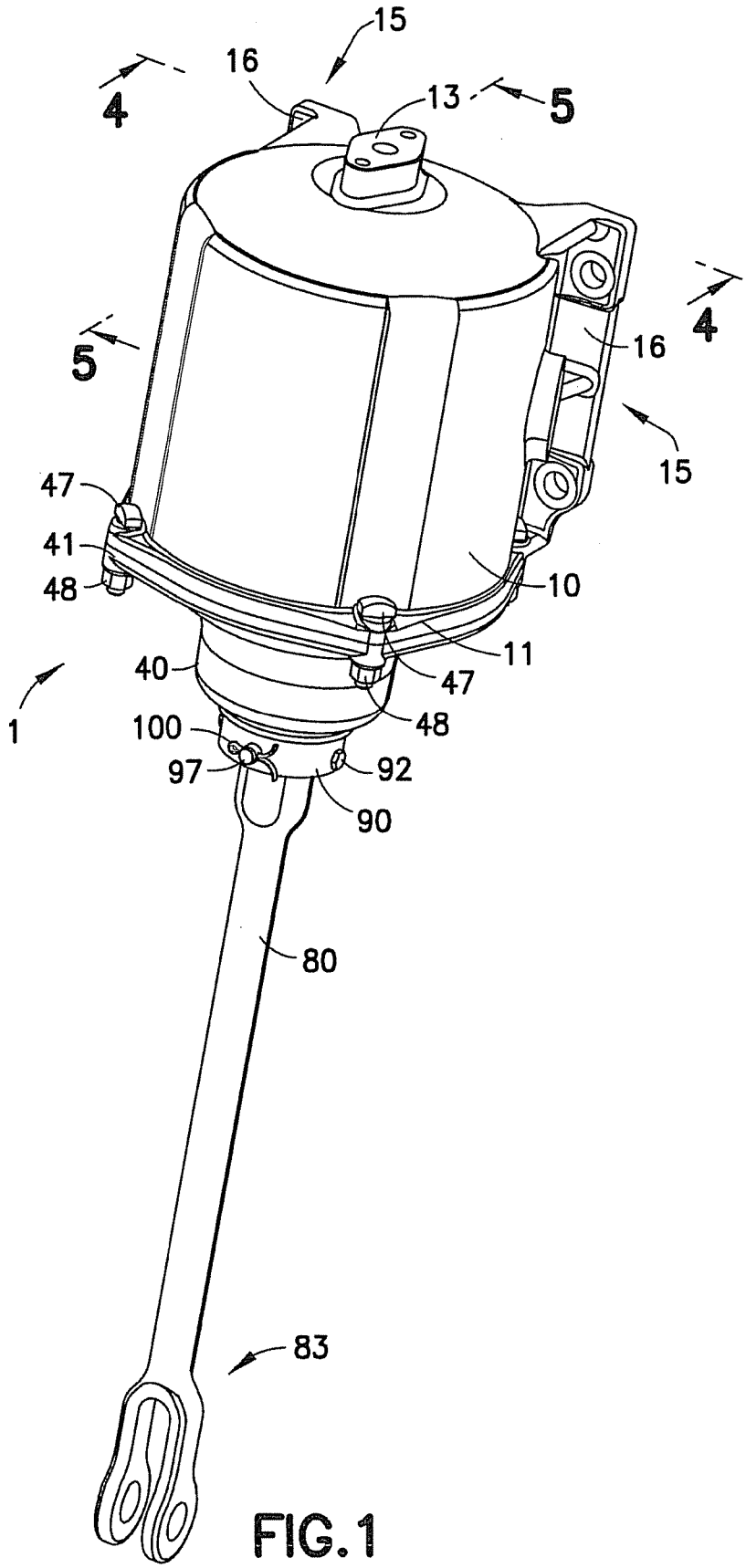
FIG. 1 is a perspective view of a pneumatic cylinder according to one embodiment.
Figure 2:
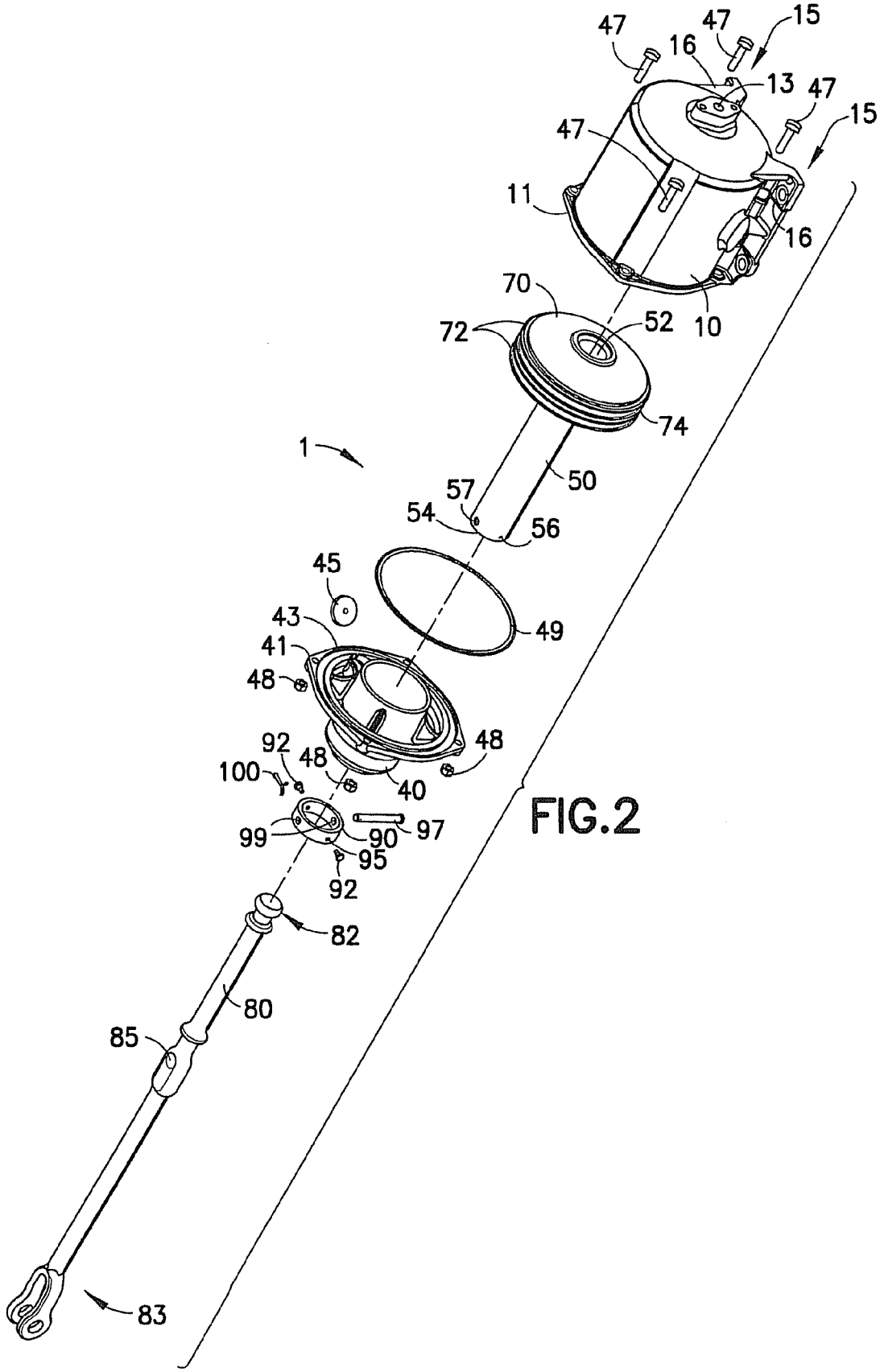
FIG. 2 is an exploded perspective view of the pneumatic cylinder shown in FIG. 1.
Figure 3:
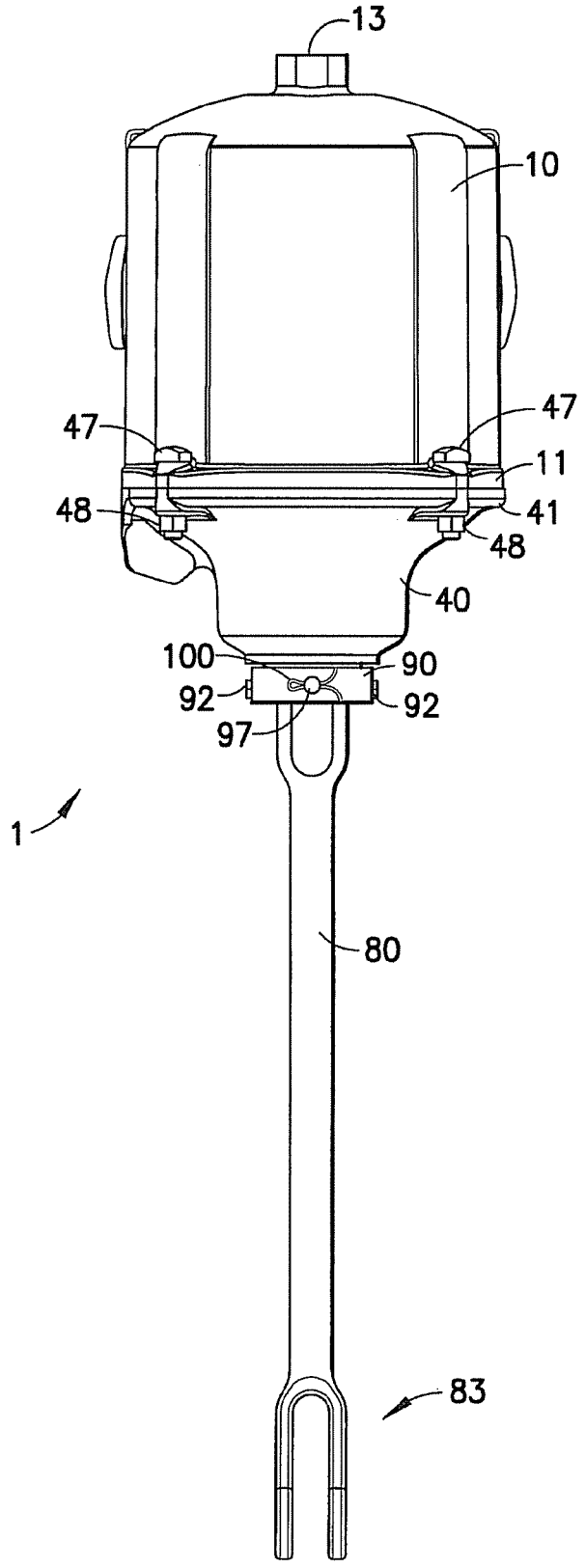
FIG. 3 is a front view of the cylinder shown in FIG. 1.

In one embodiment, shown in FIGS. 1-5, a pneumatic cylinder 1 includes a cylinder body 10, a non-pressure head 40, a hollow piston rod 50, a piston head 70, and a push rod 80. The cylinder body 10 has a mounting flange 11 and an inlet port 13. The inlet port 13 may be connected to a source of pressurized air (not shown). The non-pressure head 40 has a mounting flange 41 corresponding to the shape and dimensions of the mounting flange 11 of the cylinder body 10. Accordingly, the cylinder body 10 and the non-pressure head 40 may be joined by mating the respective mounting flanges 11, 41 to define an enclosed space within the cylinder body 10 and the non-pressure head 40. The mounting flanges 11, 41 may then be secured to one another via bolts 47 and nuts 48 that are inserted into corresponding through holes. A mounting seal 49 may be disposed between the mounting flanges 11, 41 prior to securing them to one another. Although the non-pressure head 40 and the cylinder body 10 are shown in FIGS. 1-5 to be secured via the bolts 47 and nuts 48, any suitable securing arrangement may be used to secure the non-pressure head 40 to the cylinder body 10. Further, the cylinder body 10 may include a mounting portion 15 on an outer surface of the cylinder body 10 for securing the pneumatic cylinder 1 to a structure. In certain embodiments, as shown in FIGS. 1 and 2, the mounting portion 15 is a pair of mounting feet 16.

The non-pressure head 40 may further include a vent 43 with a strainer 45 disposed within the vent 43. The vent 43 permits air to escape from the pneumatic cylinder 1 during application or extension of the pneumatic cylinder 1. Further, the vent 43 allows atmospheric air to enter the non-pressure head 40 of the pneumatic cylinder 1 to ensure proper return of the pneumatic cylinder 1.

Figure 4:
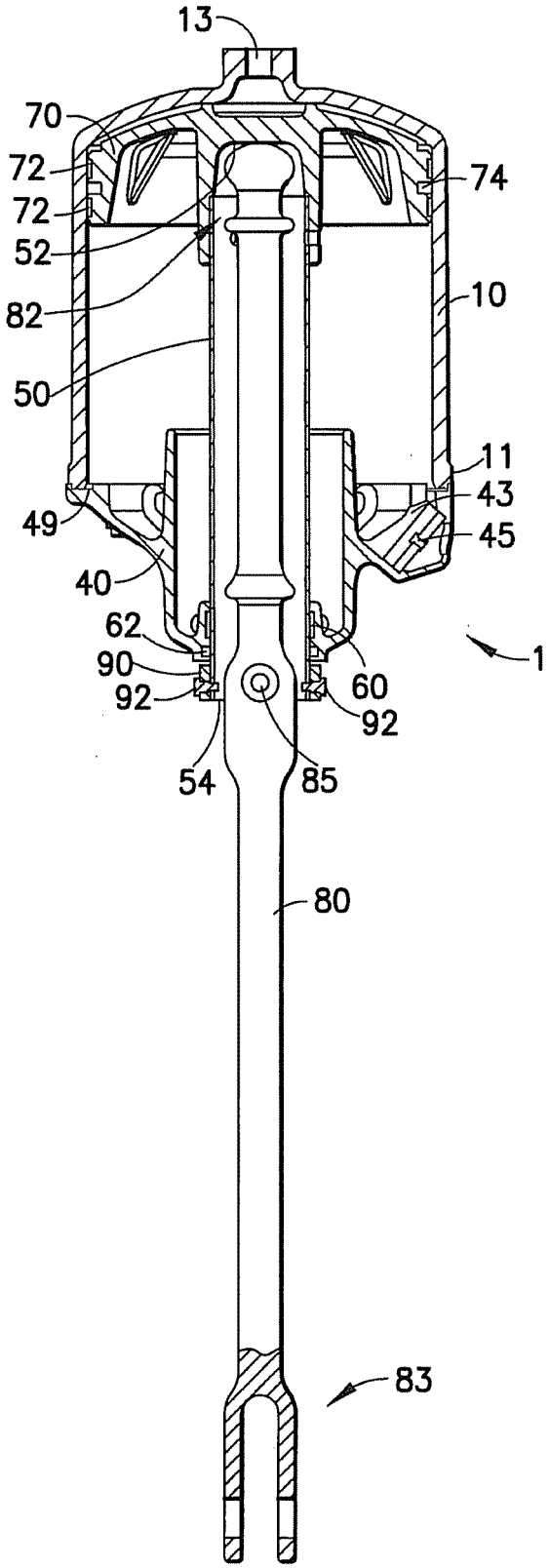
FIG. 4 is a cross-sectional view of the pneumatic cylinder taken along lines 4-4 in FIG. 1.
Figure 5:
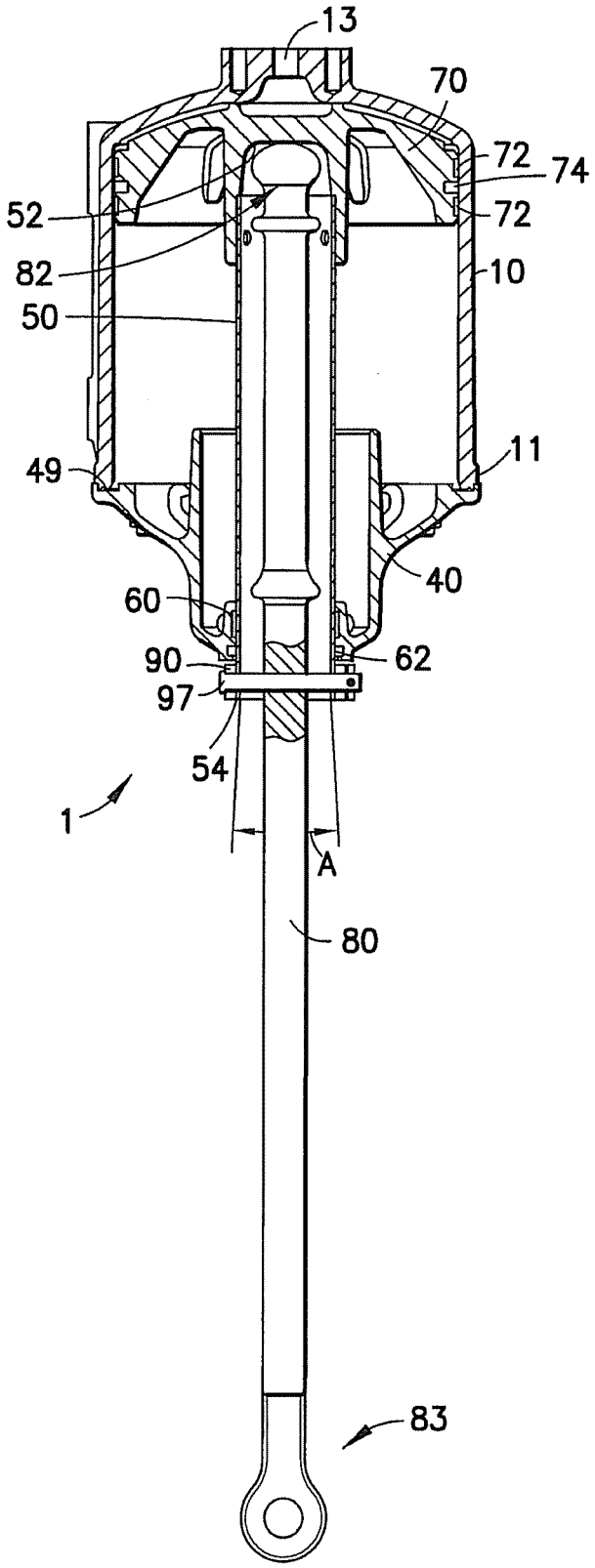
FIG. 5 is a cross-sectional view of the pneumatic cylinder taken along lines 5-5 in FIG. 1.

The hollow piston rod 50 has a closed end 52 and an open end 54. The hollow piston rod 50 has a pair of set screw holes 56 and a pin through hole 57 disposed in the area of the open end 54. The set screw holes 56 and the pin through hole 57 are oriented generally perpendicular to a longitudinal axis of the hollow piston rod 50. The piston head 70 is secured to the hollow piston rod 50 defining the closed end 52 of the hollow piston rod 50. The piston head 70 is disposed within the cylinder body 10 and together with the hollow piston rod 50 are displaceable relative to the cylinder body 10 and the non-pressure head 40. The piston head 70 includes at least one guide bearing 72 and a piston seal 74, which slidably engage in the cylinder body 10. Further, the non-pressure head 40 includes a hollow rod guide bearing 60 and a hollow rod seal 62, which slidably engage the hollow piston rod 50. As shown in FIGS. 4 and 5, the piston head 70 includes two guide bearings 72 positioned on either side of the piston seal 74. The hollow rod guide bearing 60 and the hollow rod seal 62 may be positioned adjacent one another. The seals 62, 74 and bearings 60, 72 may be low-friction seals and bearings. For instance, the bearings 60, 72 may be made of polytetrafluoroethylene (PTFE), and in particular, bronze-filled PTFE.

The push rod 80 has a socket end 82 and a coupler end 83. The socket end 82 of the push rod 80 is inserted within the hollow piston rod 50 such that the socket end 82 is adjacent the closed end 52 of the hollow piston rod 50. The push rod 80 may further include an elastomeric ring 104 (shown in FIG. 6) arranged coaxially around the socket end 82 of the push rod 80, which will be discussed in more detail below. The annular ring may be made from rubber or any other suitable material.

In order to ensure that the push rod 80 moves with the hollow piston rod 50 when the pneumatic cylinder 1 returns to a non-application position of the pneumatic cylinder 1, the push rod 80 is secured to the hollow piston rod 50 by a push rod holder 90. The push rod holder 90 is concentrically disposed around the hollow piston rod 50 and is secured to the hollow piston rod 50 via set screws 92 inserted through the set screw through holes 95 of the push rod holder 90 and the set screw holes 56 of the hollow piston rod 50. A holder pin 97 inserts through opposing pin through holes 99 in the push rod holder 90 and locking pin through hole 85 in the push rod 80 to secure the push rod holder 90 to the hollow piston rod 50 contained therein. A cotter pin 100 may be used to secure holder pin 97 in pin through holes 99.

Upon introduction of pressurized air through the inlet port 13 of the cylinder body 10, air pressure acts on the piston head 70 to displace the piston head 70 towards the non-pressure head 40. The hollow piston rod 50 with push rod 80 thereby extends from the non-pressure head 40 to transmit a force through the coupler end 83 of the push rod 80. The piston head 70, hollow piston rod 50, and push rod 80 may be returned to its original position by the weight of the structure to which the cylinder body 10 is attached.

The pneumatic cylinder 1 may be used on a locomotive platform in exemplary and desirable application. In particular, the pneumatic cylinder 1 may be used to transmit forces through a truck assembly (not shown) of a locomotive while compensating for non-linear travel of the push rod 80 and size and location variations in locomotive truck components. As described above and shown in FIGS. 1-5, the hollow piston rod 50 encapsulates the push rod 80 and functions to translate piston forces linearly along the longitudinal axis of the pneumatic cylinder 1 to maintain parallel piston travel with the wall of the cylinder body 10. Further, the socket end 82 of the push rod 80 and the hollow piston rod 50 allow the push rod 80 to swivel in the hollow push rod 50. The swiveling movement of the push rod 80 allow for clearance tolerances in the truck assembly of the locomotive that cause variation in the attachment point of the coupler end 83 of the push rod 80 to the locomotive thereby easing installation and reducing cost by allowing for lower-toleranced locomotive components. Furthermore, due to the linkages of the locomotive truck assembly, the swiveling feature of the push rod 80 permits the push rod 80 to travel through an arc of motion as the pneumatic cylinder 1 operates in service. This arcuate movement is represented by Arrows A in FIG. 5.

As discussed above and shown in FIGS. 4 and 5, the non-pressure head 40 includes the hollow rod guide bearing 60 and the hollow rod seal 62 to prevent physical contact between the hollow piston rod 50 and the non-pressure head 40. Further, the piston head 70 includes the guide bearing 72 and the piston seal 74 to prevent physical contact between the piston head 70 and the cylinder body 10. The arrangement of seals 62, 74 and bearings 60, 72 addresses non-axial, i.e., side loads, transferred to the pneumatic cylinder 1 components from the locomotive truck rigging. Further, the seals 62, 74 and bearings 60, 72 improve the response characteristics of the pneumatic cylinder 1 to control pressure modulation.

Figure 6:
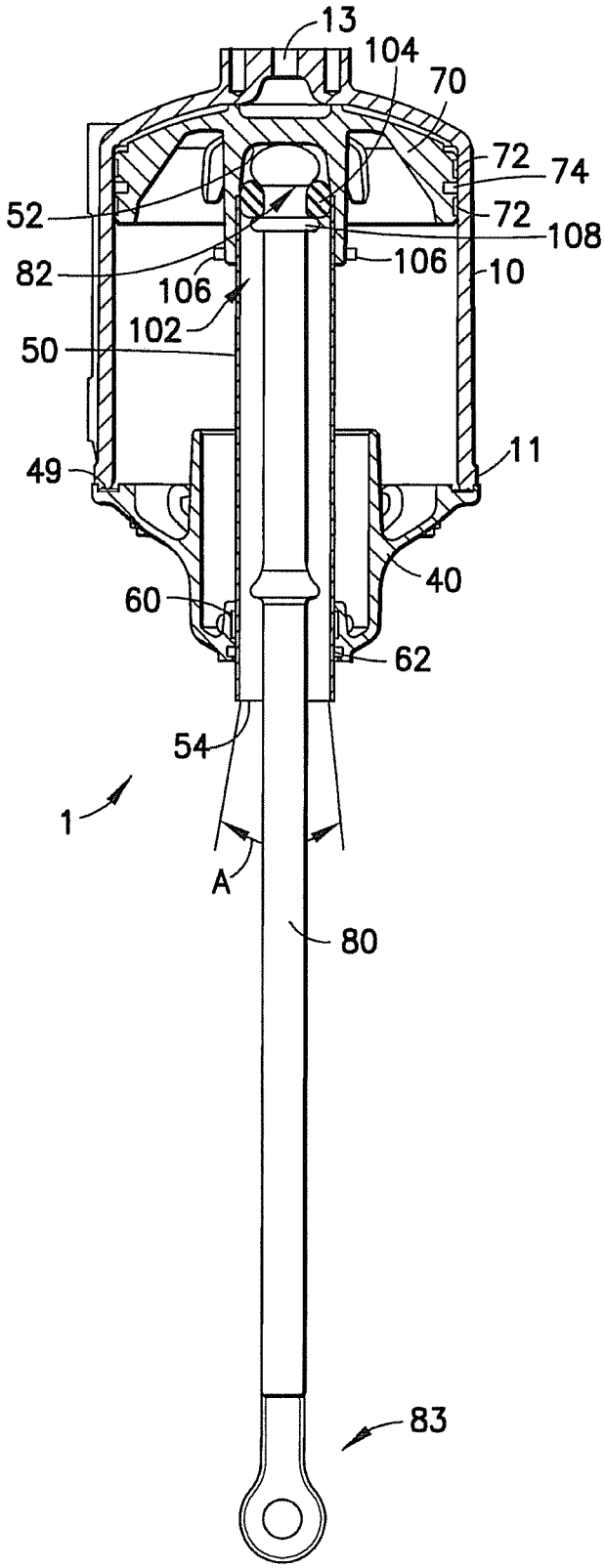
FIG. 6 is a cross-sectional view of a pneumatic cylinder according to another embodiment.

In another embodiment of pneumatic cylinder 1 shown in FIG. 6, an elastomeric ring 104 is concentrically positioned about the socket end 82 of the push rod 80 and reduces rattling of the push rod 80 within the hollow piston rod 50 but still permits arcuate movement of the push rod 80 relative to the piston head 70 associated with the hollow piston rod 50. The elastomeric ring 104 may be formed of rubber or a like resiliently flexible material. Typically, elastomeric ring 104 is seated against a flange 108 formed adjacent the socket end 82 of the push rod 80 as shown in FIG. 6. Elastomeric ring 104 permits similar arcuate movement, as represented again by arrows A in FIG. 6, of the push rod 80 relative to the piston head 70 associated with the hollow piston rod 50 as in previous embodiments. The cylinder shown in FIG. 6 may also include the push rod holder 90 discussed above and shown in FIG. 5.

Figure 7:
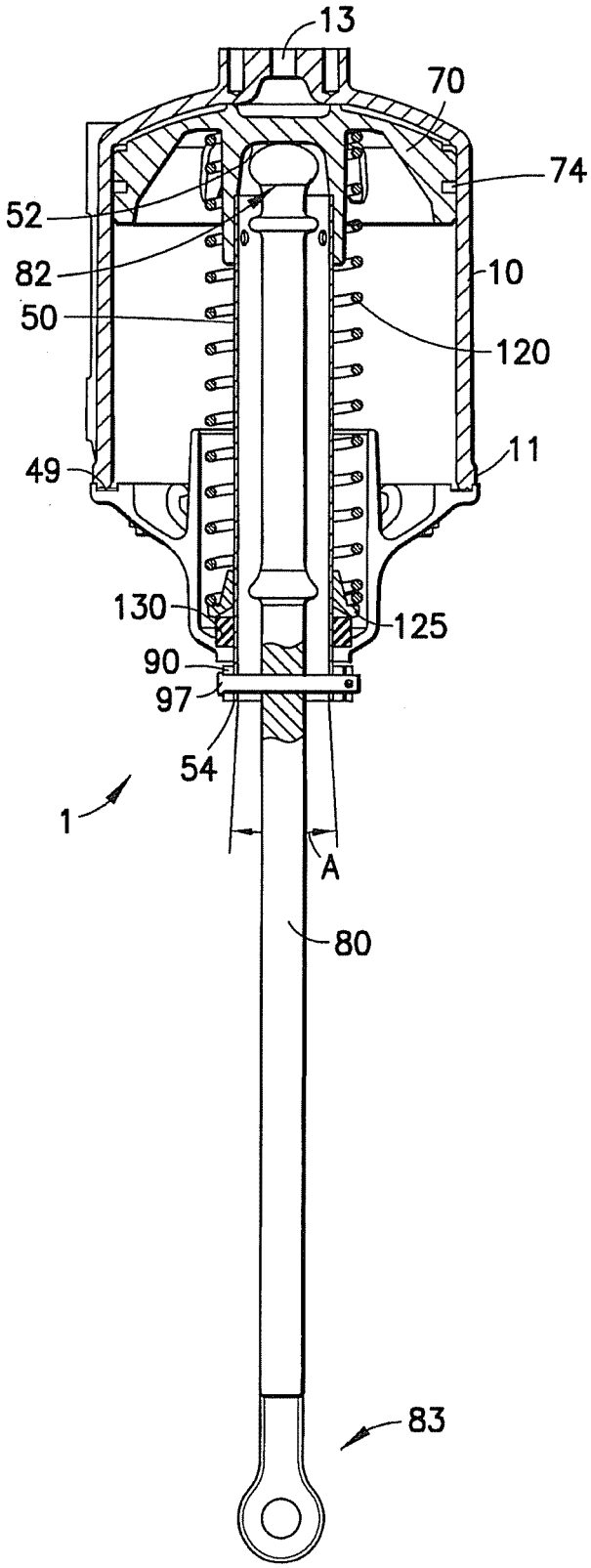
FIG. 7 is a cross-sectional view of a pneumatic cylinder according to a further embodiment.

In a further embodiment of pneumatic cylinder 1 shown in FIG. 7, the piston head 70, hollow piston rod 50, and push rod 80 may be returned to its original position after actuation by employing a return spring 120 between the piston head 70 and the non-pressure head 40. In particular, the return spring 120 engages the piston head 70 at one end and a spring seat 125 at the other end. The spring seat 125 engages a seal packing 130 positioned within the non-pressure head 40. By providing a return spring 120, when air pressure is removed from the cylinder, the piston will retract due to the force of the return spring, which is compressed during application and displacement of the piston head 70. The pneumatic cylinder 1 also includes the elastomeric ring 104 concentrically positioned about the socket end 82 of the push rod 80 as discussed above with respect to FIG. 6. Furthermore, the pneumatic cylinder 1 shown in FIG. 7 does not include the hollow rod guide bearing 60 and the hollow rod seal 62 positioned on the non-pressure head 40. The pneumatic cylinder 1 shown in FIG. 7 also does not include the guide bearings 72 positioned on the piston head 70.

Furthermore, the embodiment of the pneumatic cylinder 1 shown in FIGS. 1-5 may also include the return spring 120, spring seat 125, and seal packing 130 as shown in FIG. 7. The pneumatic cylinder 1 of FIGS. 1-5 would then be returned to its original position after actuation through the biasing action of the return spring 120.

While embodiments of a pneumatic cylinder for use on a locomotive platform were provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A pneumatic cylinder comprising:

a cylinder body comprising an inlet port, the cylinder body adapted for connection to a rail car structure;

a non-pressure head connected to an end of the cylinder body;

a hollow piston rod having an open end and a closed end, at least a portion of the hollow piston rod disposed within the non-pressure head;

a piston head associated with the hollow piston rod and defining the closed end of the hollow piston rod, the piston head being disposed within the cylinder body and displaceable relative to the cylinder body; and a push rod comprising a socket end and a coupler end, the socket end seated within the hollow piston rod to permit arcuate movement of the push rod within the hollow piston rod; and wherein the non-pressure head comprises a hollow piston rod guide bearing and a hollow piston rod seal axially positioned adjacent one another, the hollow piston rod guide bearing and the hollow piston rod seal each slidably engaging the hollow piston rod preventing physical contact between the hollow piston rod and the non-pressure head and accommodating non-axial, side loads;

wherein the piston head has a piston seal and a pair of piston guide bearings disposed on opposing sides of the piston seal, respectively, the piston guide bearings and the piston seal each slidably engage the cylinder body;

wherein an annular open space is defined between the push rod and the hollow piston rod from the closed end to the open end to permit the arcuate movement of the push rod within the hollow piston rod; and wherein the piston head, the hollow piston rod, and the push rod are returned to an original position solely by the weight of the rail car structure to which the cylinder body is attached.

2. A pneumatic cylinder as claimed in claim 1, wherein the cylinder body and the non-pressure head further comprise mating mounting flanges to secure the non-pressure head to the cylinder body.

3. A pneumatic cylinder as claimed in claim 1, wherein the piston head and associated piston rod are axially displaceable in the cylinder body.

4. A pneumatic cylinder as claimed in claim 1, wherein the coupler end comprises a U-shaped mounting bracket.

5. A pneumatic cylinder as claimed in claim 1, further comprising a vent in the non-pressure head.

6. A pneumatic cylinder as claimed in claim 1, further comprising a mounting portion on the cylinder body.

7. A pneumatic cylinder comprising:

a cylinder body comprising an inlet port, the cylinder body adapted for connection to a rail car structure;

a non-pressure head connected to an end of the cylinder body;

a hollow piston rod having an open end and a closed end, at least a portion of the hollow piston rod disposed within the non-pressure head;

a piston head associated with the hollow piston rod and defining the closed end of the hollow piston rod, the piston head being disposed within the cylinder body and displaceable relative to the cylinder body;

a push rod comprising a socket end and a coupler end, the socket end seated within the hollow piston rod; and a push rod holder secured to the hollow piston rod and further connected to the push rod to permit arcuate movement of the push rod within the hollow piston rod; and wherein the non-pressure head comprises a hollow piston rod guide bearing and a hollow piston rod seal axially positioned adjacent one another, the hollow piston rod guide bearing and the hollow piston rod seal each slidably engaging the hollow piston rod preventing physical contact between the hollow piston rod and the non-pressure head and accommodating non-axial, side loads;

wherein the piston head has a piston seal and a pair of piston guide bearings disposed on opposing sides of the piston seal, respectively, the piston guide bearings and the piston seal each slidably engage the cylinder body;

wherein an annular open space is defined between the push rod and the hollow piston rod from the closed end to the open end to permit the arcuate movement of the push rod within the hollow piston rod; and wherein the piston head, the hollow piston rod, and the push rod are returned to an original position solely by the weight of the rail car structure to which the cylinder body is attached.

8. A pneumatic cylinder as claimed in claim 7, wherein the cylinder body and the non-pressure head further comprises mating mounting flanges to secure the non-pressure head to the cylinder body.

9. A pneumatic cylinder as claimed in claim 7, wherein the piston head and associated piston rod are axially displaceable in the cylinder body.

10. A pneumatic cylinder as claimed in claim 7, wherein the coupler end comprises a U-shaped mounting bracket.

11. A pneumatic cylinder as claimed in claim 7, further comprising a vent in the non-pressure head.

12. A pneumatic cylinder as claimed in claim 7, further comprising a mounting portion on the cylinder body.

13. A pneumatic cylinder as claimed in claim 7, wherein the push rod holder supports a holder pin passing through the push rod such that the push rod moves with the piston rod during movement thereof.

14. A pneumatic cylinder comprising:

a cylinder body comprising an inlet port, the cylinder body adapted for connection to a rail car structure;

a non-pressure head connected to an end of the cylinder body;

a hollow piston rod having an open end and a closed end, at least a portion of the hollow piston rod disposed within the non-pressure head;

a piston head associated with the hollow piston rod and defining the closed end of the hollow piston rod, the piston head being disposed within the cylinder body and displaceable relative to the cylinder body;

a push rod comprising a socket end and a coupler end, the socket end seated within the hollow piston rod; and an elastomeric ring concentrically positioned about the socket end of the push rod and engaging the hollow piston rod to permit arcuate movement of the push rod within the hollow piston rod; and wherein the non-pressure head comprises a hollow piston rod guide bearing and a hollow piston rod seal axially positioned adjacent one another, the hollow piston rod guide bearing and the hollow piston rod seal each slidably engaging the hollow piston rod preventing physical contact between the hollow piston rod and the non-pressure head and accommodating non-axial, side loads;

wherein the piston head has a piston seal and a pair of piston guide bearings disposed on opposing sides of the piston seal, respectively, the piston guide bearings and the piston seal each slidably engage the cylinder body;

wherein an annular open space is defined between the push rod and the hollow piston rod from the closed end to the open end to permit the arcuate movement of the push rod within the hollow piston rod; and wherein the piston head, the hollow piston rod, and the push rod are returned to an original position solely by the weight of the rail car structure to which the cylinder body is attached.

15. A pneumatic cylinder as claimed in claim 14, wherein the elastomeric ring comprises a solid rubber ring.

16. A pneumatic cylinder as claimed in claim 14, wherein the elastomeric ring is seated against a flange formed adjacent the socket end of the push rod.

* * * * *